United States Patent [19]

Baron et al.

[11] 4,415,022

[45] Nov. 15, 1983

[54] MOUNTING FOR HEAT EXCHANGER TUBE CLEANER CAPTURING DEVICES

[75] Inventors: Walter J. Baron; Laird C. Cleaver, both of Milwaukee, Wis.

[73] Assignee: Water Services of America, Inc., Milwaukee, Wis.

[21] Appl. No.: 350,288

[22] Filed: Feb. 18, 1982

[51] Int. Cl.[3] ..... F28G 1/12

[52] U.S. Cl. ..... 165/95; 15/3.51

[58] Field of Search ..... 165/95; 15/3.51

[56] References Cited

U.S. PATENT DOCUMENTS

| | | | |
|---|---|---|---|
| 3,319,710 | 5/1967 | Heeren et al. | 165/95 |
| 3,883,431 | 5/1975 | Ishii et al. | 15/3.51 X |
| 4,124,065 | 11/1978 | Leitner et al. | 165/95 |

FOREIGN PATENT DOCUMENTS

| | | | |
|---|---|---|---|
| 1501351 | 11/1969 | Fed. Rep. of Germany | 165/95 |
| 2127715 | 12/1972 | Fed. Rep. of Germany | 165/95 |
| 1018524 | 1/1966 | United Kingdom | 165/95 |
| 667762 | 6/1979 | U.S.S.R. | 15/3.51 |

*Primary Examiner*—Sheldon J. Richter

*Attorney, Agent, or Firm*—Andrus, Sceales, Starke & Sawall

[57] ABSTRACT

A heat exchanger has a plurality of fluid flow tubes secured adjacent their ends by tube sheets. Cleaning elements are adapted to shuttle back and forth in the tubes and are adapted to be received by capturing cages. The inner ends of the cleaning element capturing cages are provided with enlarged collars having generally semi-circular flanges providing inclined undercut seats. The heat exchanger tube ends extend fully through the openings in the tube sheets and are provided with annular flared lips extending outwardly from the outer tube sheet faces. The cages are mounted directly to the tubes by bringing the collar seats down into hanging engagement with the tube lips.

4 Claims, 5 Drawing Figures

MOUNTING FOR HEAT EXCHANGER TUBE CLEANER CAPTURING DEVICES

U.S. PRIOR ART OF INTEREST

| U.S. Pat. No. | Inventor | Issue Date |
|---|---|---|
| 3,319,710 | Heeren et al. | May 16, 1967 |
| 4,124,065 | Leitner et al. | Nov. 7, 1978 |

BACKGROUND AND SUMMARY OF THE INVENTION

This invention relates to shuttle cleaning of heat exchanger tubes and is an improvement over the concepts disclosed in the above-identified patents.

It is known from U.S. Pat. Nos. 3,319,710 and 4,124,065 to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements, such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

In the known prior devices, the cleaning element capturing cages have been mounted for communication with the tubes by securing them into the same openings in the tube sheets that the tube ends are secured into. They have been press fit either into the tube ends themselves, or directly into the tube sheet openings. See the above-identified patents.

While the press-fitting of the cages into the tube sheets provides for a good connection therebetween, this method of assembly poses certain problems. Hundreds, if not thousands, of cages may need to be utilized in any given heat exchanger installation. To press-fit each and every cage into the tube sheets is a time consuming laborious task. Furthermore, if one or more cages needs to be removed for servicing, replacement or for gaining access to the tube interiors, disconnection of the cage or cages is also difficult.

It is a task of the present invention to provide an improved mounting for heat exchanger tube cleaner capturing cages which substantially solves the aforementioned problems and permits quick and easy mounting or release of the cages from their support.

In accordance with various aspects of the invention, the inner ends of the cleaning element capturing cages are provided with enlarged collars having generally semi-circular flanges providing inclined undercut seats. The heat exchanger tube ends extend fully through the openings in the tube sheets and are provided with annular flared lips extending outwardly from the outer tube sheet faces. The cages are mounted directly to the tubes by bringing the collar seats down into hanging engagement with the tube lips.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
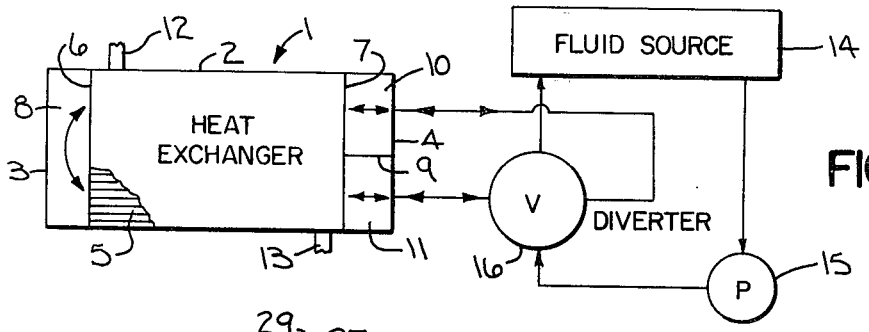
FIG. 1 is a schematic showing of a heat exchanger and fluid flow controls thereof.
Figure 2:
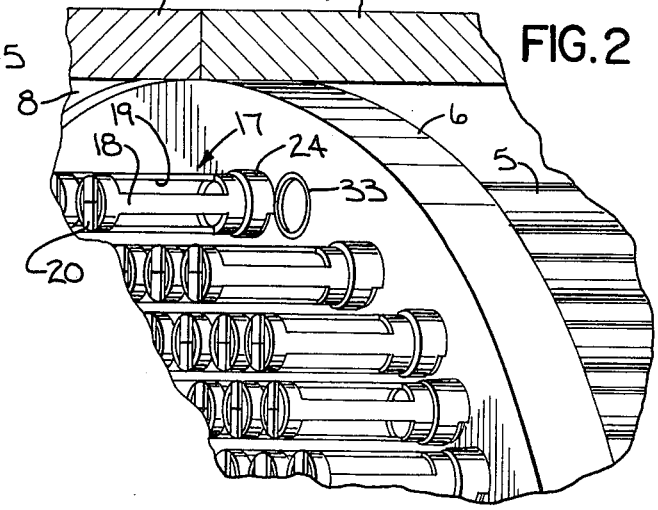
FIG. 2 is a fragmentary perspective view of a portion of the heat exchanger interior.

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, the ends of each tube 5 are disposed in communication with a capturing device which comprises a longitudinally extending basket or cage 17 having a cylindrical wall 18 with elongated fluid flow slots 19 therein. The outer end of cage 17 is provided with an abutment 20.

Cage 17 is adapted to capture and hold a tube cleaning device 21 which is adapted to shuttle back and forth through the tube in response to a change in direction of fluid flow caused by actuation of diverter valve 16. Device 21 may be of any desired type, that shown having a coil spring 22 freely shiftable along a central rod 23.

The various aspects of the invention are directed to an improved mounting of cages 17 within the heat exchanger.

Figure 4:
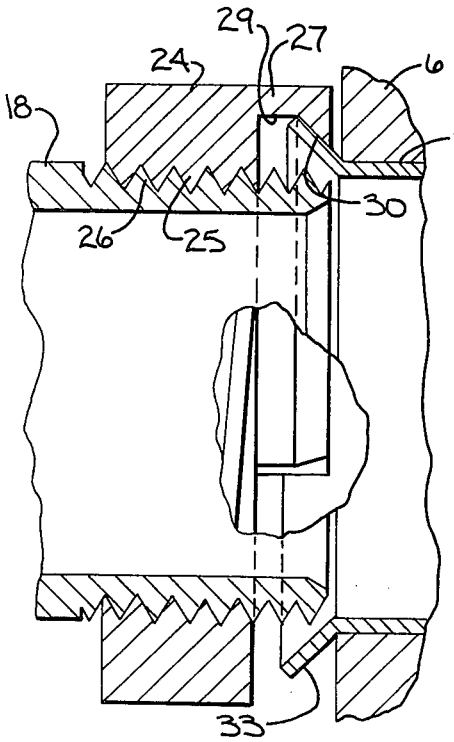
FIG. 4 is an enlarged vertical section of the cage mount.
Figure 3:
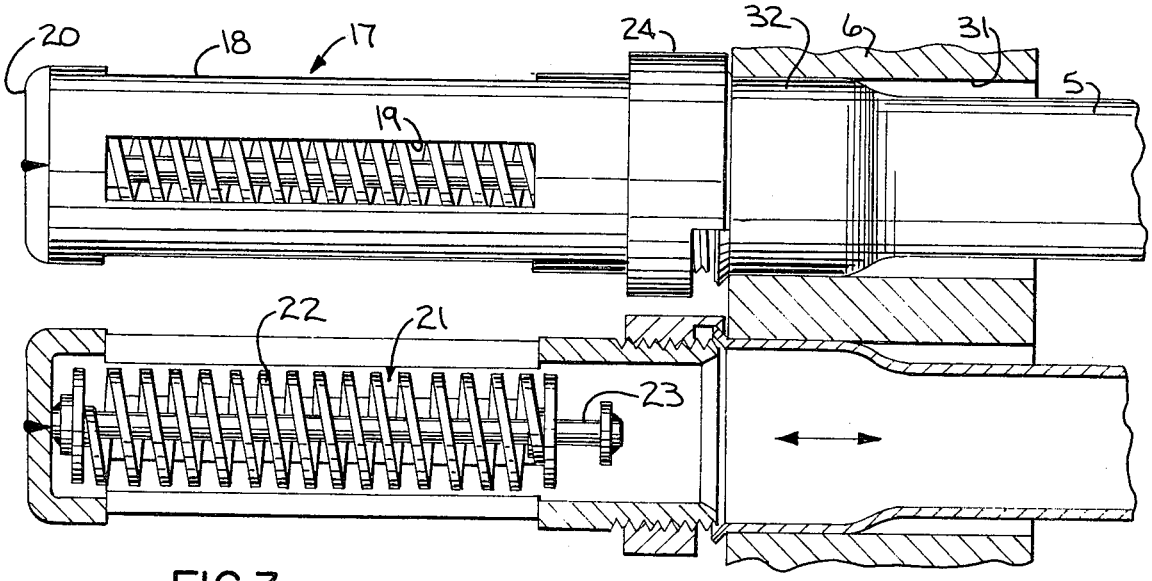
FIG. 3 is a fragmentary longitudinal side view through a portion of the heat exchanger showing two tubes with cages mounted thereon, and with parts in section.

As best shown in FIGS. 3 and 4, the inner end of cage 17 is provided with an enlarged collar 24 which in the present embodiment comprises a separate member having internal threads 25 which are screwed onto threads 26 on cage 17.

Collar 24 is provided with a semi-circular arcuate flange 27 on its outer end, the flange extending slightly more than 180° around the collar and terminating at flange ends 28. Flange 27 is formed to provide an internal arcuate groove 29 and an inclined undercut seat 30.

For purposes of mounting the combined cage-collar device, tubes 5 are shown as extending all the way through openings 31 in tube sheet 6. (The same would be true of tube sheet 7.) A portion of the tube 5 within the respective opening 31 is enlarged, as at 32, to engage the opening wall. Furthermore, each tube 5 extends outwardly of the outer face of tube sheet 6 and terminates in an exposed annular radially outwardly flared end lip portion 33.

Figure 5:
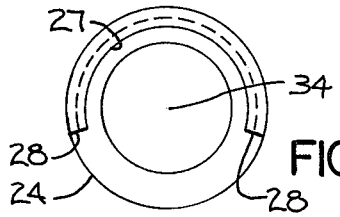
FIG. 5 is an inner end view of the collar.

To mount the cage-collar device within the heat exchanger, the device is rotated until flange 27 is oriented as shown in FIG. 5, that is, over the longitudinal axis 34 of the device. Collar 24 is then lowered down onto a tube lip 33 so that seat 30 engages the latter and is lockingly held in mating engagement therewith so that cage 17 now hangs from the tube.

Quick release of cage 17 from tube 5 is readily accomplished by merely lifting the cage from the flared lip 33.

The concepts of the invention provide an easily connectable quickly releaseable mounting for tube cleaning element capturing cages. No special rotary orientation of tubes 5 is necessary, the aligning all being accomplished via collar 24.

Various modes of carrying out the invention are contemplated as being within the scope of the following claims particularly pointing out and distinctly claiming the subject matter which is regarded as the invention.

We claim:

1. A heat exchanger comprising:

(a) a housing, (b) a plurality of longitudinally extending fluid flow tubes disposed within said housing, (c) tube sheets disposed within said housing and with said tube sheets having openings receiving said tubes, (d) longitudinally extending cages disposed in communication with said tubes for receiving shuttling tube cleaning elements, (e) the end portions of said tubes extending longitudinally outwardly of said tube sheets, (f) and means for quick releasably mounting said cages to said tube end portions outwardly of said tube sheets, said mounting means including:

(1) an arcuate undercut seat disposed on the inner end of a respective cage, (2) and a flared lip on the outer end portion of a respective adjacent tube, (3) said seat and lip engaging to releasably hang said cage from said tube.

2. The heat exchanger of claim 1 which includes:

(a) a collar disposed at the inner end of said cage, (b) and a semi-circular arcuate flange extending outwardly from said collar and with said flange having said seat therein.

3. The heat exchanger of claim 2 which includes means mounting said collar to said cage.

4. The heat exchanger of claim 3 wherein said last-named mounting means comprises a threaded connection between said collar and said cage.

* * * * *